US007043939B2

(12) United States Patent
Imahashi

(10) Patent No.: US 7,043,939 B2
(45) Date of Patent: May 16, 2006

(54) BAND-LIKE RING

(75) Inventor: Toru Imahashi, Tokyo (JP)

(73) Assignee: IMAC Business Corporation, Tokyo (JP)

( * ) Notice: Subject to any disclaimer, the term of this patent is extended or adjusted under 35 U.S.C. 154(b) by 14 days.

(21) Appl. No.: 10/640,673

(22) Filed: Aug. 14, 2003

(65) Prior Publication Data

US 2005/0034482 A1 Feb. 17, 2005

(51) Int. Cl.
*A44C 9/02* (2006.01)
*A44S 5/00* (2006.01)

(52) U.S. Cl. ..... 63/15.65; 63/3.1; 63/3.2; 63/15.5

(58) Field of Classification Search ..... 63/1.11, 63/1.18, 12, 3, 3.1, 3.2, 4, 5.1, 15–15.65, 63/41; 24/68 J, 265 R, 265 EC, 574.1
See application file for complete search history.

(56) References Cited

U.S. PATENT DOCUMENTS

| | | | | | |
|---|---|---|---|---|---|
| 754,714 | A | * | 3/1904 | Sedlmair | 24/191 |
| 946,342 | A | * | 1/1910 | Doppenschmitt | 63/11 |
| 1,640,522 | A | * | 8/1927 | White et al. | 150/108 |
| 1,779,068 | A | * | 10/1930 | Krementz | 63/4 |
| 1,797,583 | A | * | 3/1931 | Miller | 428/608 |
| 1,831,452 | A | * | 11/1931 | Johnson | 63/5.1 |
| 2,258,417 | A | * | 10/1941 | Lund et al. | 24/265 WS |
| 2,462,425 | A | * | 2/1949 | Pratt et al. | 63/3 |
| 2,508,147 | A | * | 5/1950 | Dutch | 63/5.1 |
| 4,158,951 | A | * | 6/1979 | Cedar | 63/5.1 |

FOREIGN PATENT DOCUMENTS

| | | | | |
|---|---|---|---|---|
| CH | 47831 | * | 8/1910 | 63/5.1 |
| CH | 132673 | * | 6/1928 | 63/3 |
| DE | 681 404 | * | 9/1939 | 63/5.1 |
| GB | 233872 | * | 5/1925 | 63/5.1 |

* cited by examiner

*Primary Examiner*—Robert J. Sandy
*Assistant Examiner*—Ruth C. Rodriguez
(74) *Attorney, Agent, or Firm*—Wenderoth, Lind & Ponack, L.L.P.

(57) ABSTRACT

An adjustable band ring includes a band formed by threading a thread through a thread hole provided on each of individual jewel or precious metal beads, a chain-like band formed by joining individual sub-chains made of precious metals, or a ring band formed by joining individual sub-rings made of precious metals. The ring further includes a band retainer on the base end of the band for holding the side of a middle portion of the band that has completely been wound around the finger, a hook on the forward end of the band extending beyond the band retainer and adapted to engage the side of the middle portion of the band, and a plurality of individual jewel beads mounted on the side of the band retainer that will be located on the upper face side of the band retainer when the ring is mounted on the finger.

14 Claims, 11 Drawing Sheets

BAND-LIKE RING

BACKGROUND

1. Field of the Invention

The present invention relates to a band-like ring that has jewels, precious stones and the like mounted thereon.

2. Prior Art

Ordinary rings are usually designed and made so that each ring can fit the size of the finger of an individual user on which the ring is to be mounted. The ring that is specifically designed to fit the finger of one user may not fit the finger of another user. In this case, the ring would become of no utility unless appropriate modifications are made to the original ring. Thus, the ring must be modified so that it can fit the finger of the user each time the user purchases a ring in which the user is interested.

As contrasted with the ordinary rings described above, a band-like ring includes a band and a band retainer such as a buckle, and is designed to permit the length of the band to be adjusted to any desired length by the band retainer. No modifications are required, therefore, in order to permit the ring to fit the finger of a particular user. Such band-like rings (i.e. adjustable band rings) may be used as presents or gifts without having to care about the size of the finger of any potential recipient.

One example of the band-like ring is disclosed in Japanese Utility Model Registration Application published under No. Showa 60 (1985)-91017, and includes a band and a buckle secured to the base end of the band. The band has holes that are provided at proper positions, and the buckle is made of a frame including a hook that can be brought into engagement with any of the holes. When this band-like ring is mounted on the finger, it may be mounted on the finger by first inserting the forward end of the band into the frame of the buckle, and then allowing the hook of the buckle to engage any proper hole so that the middle portion of the band can be securely held within the buckle. The buckle includes a platinum plate within its frame, on which tiny jewel beads are mounted.

In the band-like ring described above, the holes are provided at intervals that allow the band to be adjusted to any length. For this reason, the holes must be provided closely to each other. If the band is relatively long as compared with the size of the finger, or if the finger is relatively thin as compared with the length of the band when the ring is mounted on the finger, some looseness will occur on the forward end side of the band. This looseness on the forward end side might easily be caught by any other object, and might also be an obstruction as it is apart from the finger.

The prior art band-like ring has disadvantages in that the location of the ring where tiny jewel beads can be mounted is limited, and the area where tiny jewel beads can be mounted is also limited.

SUMMARY OF THE INVENTION

It is one object of the present invention to provide a band-like ring (i.e. adjustable band ring) that permits the user to adjust the length of the band according to the size of his or her finger on which the band-like ring is to be mounted. A mechanism is provided for avoiding any looseness of the band that would otherwise occur on the forward end side thereof even if the band is relatively long as compared with the size of the finger, or even if the finger is relatively thin as compared with the length of the band.

Another object of the present invention is to provide the band-like ring defined above in the first object, wherein jewel beads can be mounted anywhere without any limitations on the location where the jewel beads should be mounted.

The present invention may achieve the above objects by providing the band-like ring that will be described below. The band-like ring may include any of the variations of a band that will be described below.

In one aspect of the present invention, the band-like ring may include a band that is woven by threading threads through a plurality of individual tiny jewel or precious metal beads, each of the jewel or precious metal beads having thread holes through which threads can be inserted.

In another aspect of the present invention, the band-like ring may include a chain band that is made of a plurality of tiny precious metal sub-chains that are linked together into a chain In still another aspect of the present invention, the band-like ring may include a ring band that is made of a plurality of tiny precious metal sub-rings that are linked together into a ring.

It may be appreciated that the jewels may include natural jewels and synthetic jewels, and the precious metals may include gold, silver, platinum, white gold and the like. The chain band may include tiny sub-chains, each having an inner diameter of about 1 mm, which may be linked together or woven by passing threads through the sub-chains. The ring band may include tiny sub-rings, each having an inner diameter of about 1 mm, which may be linked together or woven by passing threads through the sub-rings.

The band-like ring according to the present invention may further include a band retainer that is provided on the base end side of the band for holding the middle portion of the band that will be located nearer to the forward end side of the band that has completely been wound around the finger when the band-like ring is mounted on the finger.

The band-like ring may further include a hook member that is provided on the forward end side of the band held by the band retainer and extending beyond the band retainer so that it can engage the side of the middle portion of the band located nearer to the base end side of the band.

The band retainer may include a plurality of tiny jewel beads that are mounted on the area thereof that will be located on the face side when the ring is mounted on the finger.

More specifically, the band retainer may include a frame having its base end mounted to the base end of the band and a stopper. The stopper has its base end mounted pivotally to the base end of the frame, and its forward end may abut against the middle portion of the band that will be located nearer to the forward end side of the band that has been passed through the frame when the band is completely wound around the finger as the band-like ring is mounted on the finger. Thus, the band retainer may act as a band buckle.

The band retainer may also include a plurality of tiny jewel beads that are mounted on the face side of the frame. The band retainer itself may be made of any of the precious metals.

As a variation of the band retainer, it may include a plate having one lateral edge secured to the base end of the band and a jewel support plate. The jewel support plate includes a hook member on its forward end, and the hook member has its base end mounted pivotally to one side of the plate perpendicular to the above-mentioned one lateral edge of the plate, and is adapted to engage the other side of the plate perpendicular to the above-mentioned one lateral edge of the plate.

The jewel support plate may include a plurality of tiny jewel beads that are mounted on the face side thereof. The jewel support plate itself may be made of any of the precious metals.

The jewel support plate may be formed to have the shape of a character or letter, an animal, a heart mark, or a rectangular shape having a central opening on the face side thereof on which the jewel beads are mounted.

The hook member that is provided on the forward end side of the band as described above may include a fastener and a hook. The fastener is coupled to the forward end of the band, and the hook is provided to extend from the fastener and is adapted to engage the middle portion of the band that will be located behind the forward end of the band held by the band retainer and extending beyond the band retainer when the band-like ring is mounted on the finger.

The fastener may include a plurality of jewel beads that are mounted on the side thereof that will be located on the face side when the ring is mounted on the finger. The fastener itself may be made of any of the precious metals.

As described above, the band-like ring according to the present invention includes any of the variations of a band. In other words, the band can be woven by threading threads through a plurality of individual tiny jewel or precious metal beads so that each jewel or precious metal bead has thread holes through which threads can be inserted, the band can be a chain band that is made of a plurality of tiny precious metal sub-chains that are linked together, or the band can be a ring band that is made of a plurality of tiny precious metal sub-rings that are linked together.

The hook in the hook member that is provided on the forward end of the band or the stopper in the buckle-type band retainer may be provided so that it can be inserted between two adjacent jewel beads or precious metal beads, into each of the individual precious metal sub-chains or between two adjacent sub-chains, or into each of the individual precious metal sub-rings or between two adjacent sub-rings. This permits the user to fine-adjust the length of the band with higher precision when the band-like ring is being mounted on the user's finger.

It may be appreciated from the preceding description that the band-like ring provides several advantages over any of the prior art rings as described below. One advantage is that the hook in the hook member provided on the forward end side of the band or the stopper in the buckle-type band retainer can engage any appropriate one of the holes on the band that may be arranged closely to each other. Another advantage is that the band-like ring can be bent so flexibly that it can agree with the finger.

A further advantage is that the hook member that is provided on the forward end side of the band (more specifically, the forward end side of the band held by the band retainer and extending beyond the band retainer) can engage the side of the middle portion of the band that will be located nearer to the band. Therefore, the hook member can prevent any loosening of the band from occurring on the forward end side thereof, even when the band is relatively long as compared with the size of the finger, or even if the finger is relatively thin as compared with the length of the band. For the band-like ring that employs the band retainer including the plate and jewel support plate, the hook member may serve to fine-adjust the length of the band according to the particular size of the finger when it is being wound around the finger.

A further advantage of the band-like ring is that it allows jewel beads to be mounted over the wide area, regardless of whether it employs the buckle-type band retainer or the band retainer including the plate and jewel support plate. The face side of the hook member that is provided on the forward end side of the band may also be used as the area in which jewel beads are to be mounted.

DETAILED DESCRIPTION OF THE INVENTION

Figure 1:
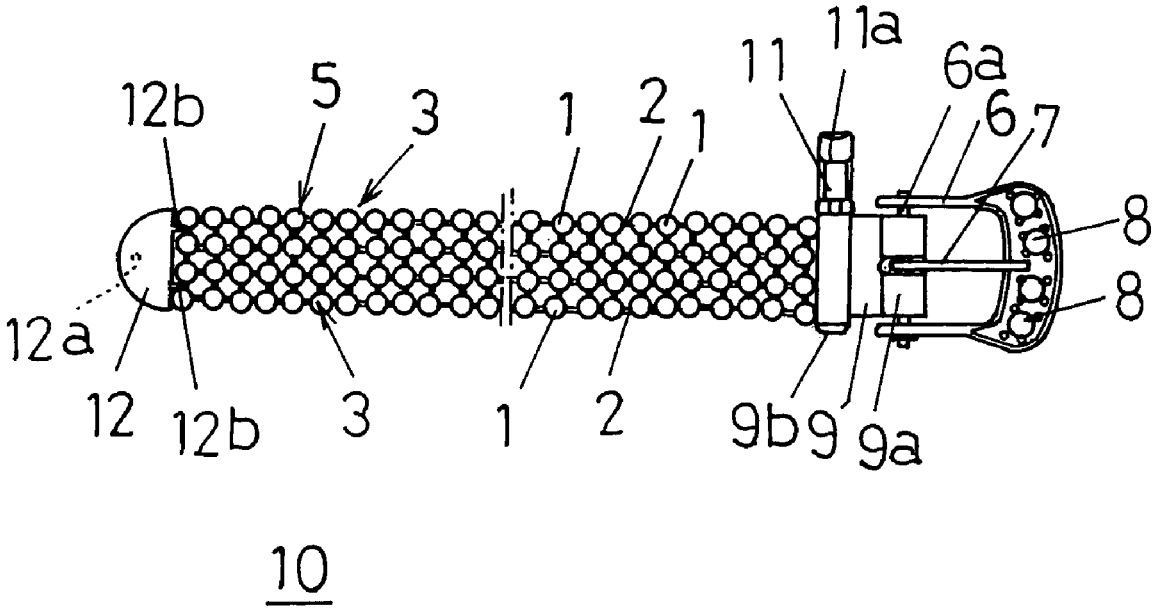
FIG. 1 is a plan view of the band-like ring according to one embodiment of the present invention as it is unfolded with the middle portion thereof being omitted, as viewed from the face side thereof.

Now, the present invention will be described with reference to several preferred embodiments thereof shown in the accompanying drawings.

EMBODIMENT 1

In this embodiment, a band-like ring (adjustable band ring) 10 includes a band 5 that may be woven by threading threads 2, 2 through a plurality of white gold beads 1, 1, each having a 0.5 mm diameter and having a threading hole through which a thread 2 can be threaded. The thread can be a gold thread or a silver thread, for example.

The band 5 may be woven, for example, so that it includes several rows 3 of white gold beads 1, 1, wherein the white gold beads 1, 1 in each row may be joined serially in the longitudinal direction (horizontal direction in FIG. 1) by threading the thread 2 through each of the white gold beads 1, 1. Four rows of white gold beads are provided in this embodiment. Then, each row of the white gold beads 1, 1 may be joined by threading a thread through each white gold bead in each adjacent row in the transverse direction (vertical direction in FIG. 1).

The band 5 may include a band retainer on its base end (on the right-hand side in FIG. 1), and a hook member on its forward (distal) end (on the left-hand side in FIG. 1) for engaging a middle portion of the band 5 when it is wound around the finger. The band retainer serves to hold the side of the middle portion of the band 5 that will be located nearer to the forward end of the band 5 that has completely been wound around the finger when the band-like ring 10 is mounted on the finger.

The hook member engages the band 5, and causes the forward (distal) end of the band 5 (the upper part of the band 5 in FIG. 4) held by the band retainer and extending beyond the band retainer to engage the side of the middle portion of the band located close to the base end (the left-hand side in FIG. 4) of the band 5 (the upper part of the band 5 in FIG. 1). The base end will be located behind the forward end of the band 5 when the band 5 has completely been wound around the finger.

In the embodiment shown in FIG. 1, the band retainer may have a construction that will be described below.

The band retainer includes a plate having one lateral edge mounted pivotally to the base end of the band 5. In the embodiment shown in FIG. 1, the plate takes the form of a mounting member 9 having one lateral edge (that is, the left side edge in FIG. 1) mounted to the base end of the band 5.

The band retainer further includes a jewel support plate 11 having its base end mounted pivotally to the side of the band 5 which is perpendicular to the left side edge of the mounting member 9 (the upper side in FIG. 1). The jewel support plate 11 is provided with a hook member 11*a* at the forward end thereof. When the jewel support plate 11 is rotated in the direction of an arrow 100 in FIG. 3, it may cause the hook member 11*a* on the forward end side of the jewel support plate 11 to engage the hook member 9*b* on the lower side of the mounting member 9 shown in FIG. 1.

Figure 2:
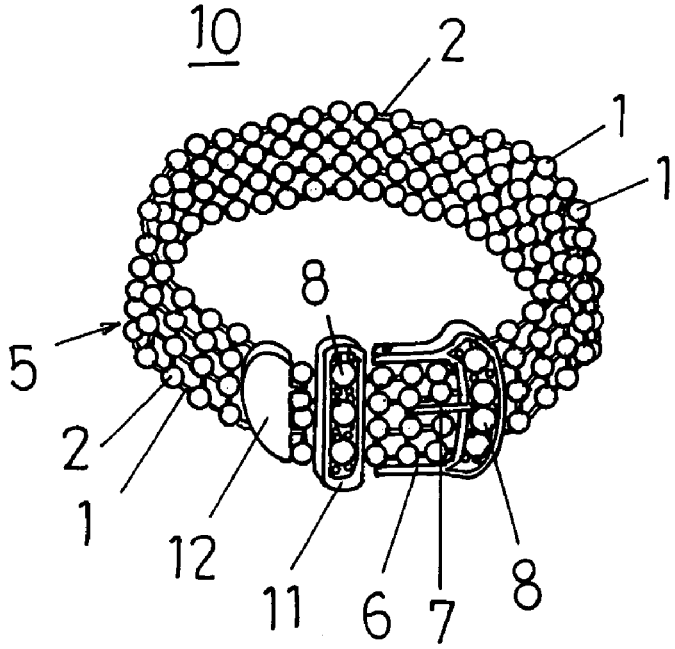
FIG. 2 is a perspective view illustrating the band-like ring of FIG. 1, as it is mounted on the finger.

The middle portion of the band 5 that is located nearer to the forward end side of the band 5 that has completely been wound around the finger as the band-like (adjustable band) ring 10 to be mounted on the finger as shown in FIG. 2 may then be sandwiched between and held by the mounting member 9 and the jewel support plate 11.

A frame (shown as a buckle frame 6 in the embodiment of FIG. 1) has its base end member 6*a* mounted pivotally to the end 9*a* of the mounting member 9 that is located on the right-hand side in FIG. 1. Furthermore, a stop member (shown as a hook rod 7 in the embodiment of FIG. 1) has its base end mounted pivotally to the base end member 6*a* of the buckle frame 6.

The forward end of the hook rod (stop member) 7 may abut against a first middle portion of the band 5 located nearer to the forward end of the band 5 that has completely been wound around the finger when the band-like ring 10 is mounted on the finger, as shown in FIG. 2. It may be seen from FIG. 2 that the first middle portion of the band 5 that is located nearer to the forward end side of the band 5 that has completely been wound around the finger when the band-like ring 10 is mounted on the finger can be held firmly between the mounting member 9 and jewel support plate 11, and can also be held by the forward end of the hook rod abutting against the middle portion of the band 5. The part of the band retainer that will be located on the face side (i.e. the side facing outward away from the finger when the ring is mounted on the finger) of the band retainer when the band-like ring 10 is mounted on the finger (the face side of the buckle frame 6 and face side of the jewel support plate 11 in the embodiments of FIGS. 1 and 2, respectively) has a plurality of individual tiny jewel beads disposed thereon.

The buckle frame 6, hook rod 7, mounting member 9, jewel support plate 11 and the like may be made of any precious metal such as platinum.

In the embodiment shown in FIG. 1, the hook member that is adapted to engage a second middle portion of the band 5 includes a fastener 12 coupled with the forward end of the band 5 and a hook 12*a* extending from the fastener 12. The fastener 12 and hook 12*a* may also be made of any precious metal such as platinum.

Figure 4:
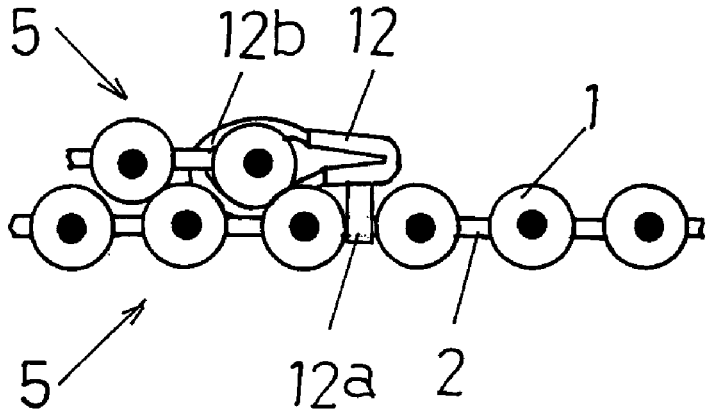
FIG. 4 is a side view illustrating the hook member in the band-like ring of FIG. 1, showing how the hook member engages the forward end of the band.
Figure 5:
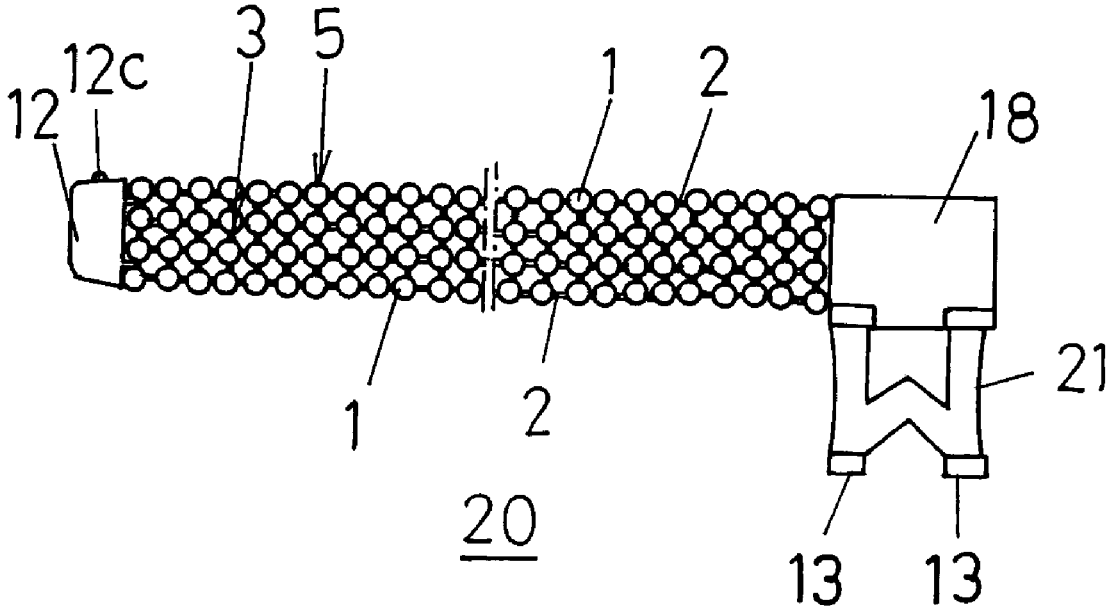
FIG. 5 is a plan view of the band-like ring according to another embodiment of the present invention as it is unfolded with the middle portion thereof being omitted, as viewed from the face side thereof.

As shown in FIG. 1 and FIG. 4, the fastener 12 has clasp parts 12*b*, 12*b* on its right-hand side mounted pivotally to the left-hand side of the band 5 shown in FIG. 1. The hook 12*a* may be made to engage the second middle portion of the band 5 located nearer to the base end side (the left-hand side in FIG. 4) of the band 5 than the first middle portion, and the second middle portion will be located behind the forward (distal) end of the band 5 (the upper part of the band 5 in FIG. 4). The forward end will be held by the band retainer and will extend beyond the band retainer when the band-like ring 10 is mounted on the finger. More specifically, as shown in FIG. 4, the hook 12*a* may be made to engage the gap between the adjacent white gold beads 1, 1 and thread 2 by inserting the hook 12*a* into that gap.

Figure 3:
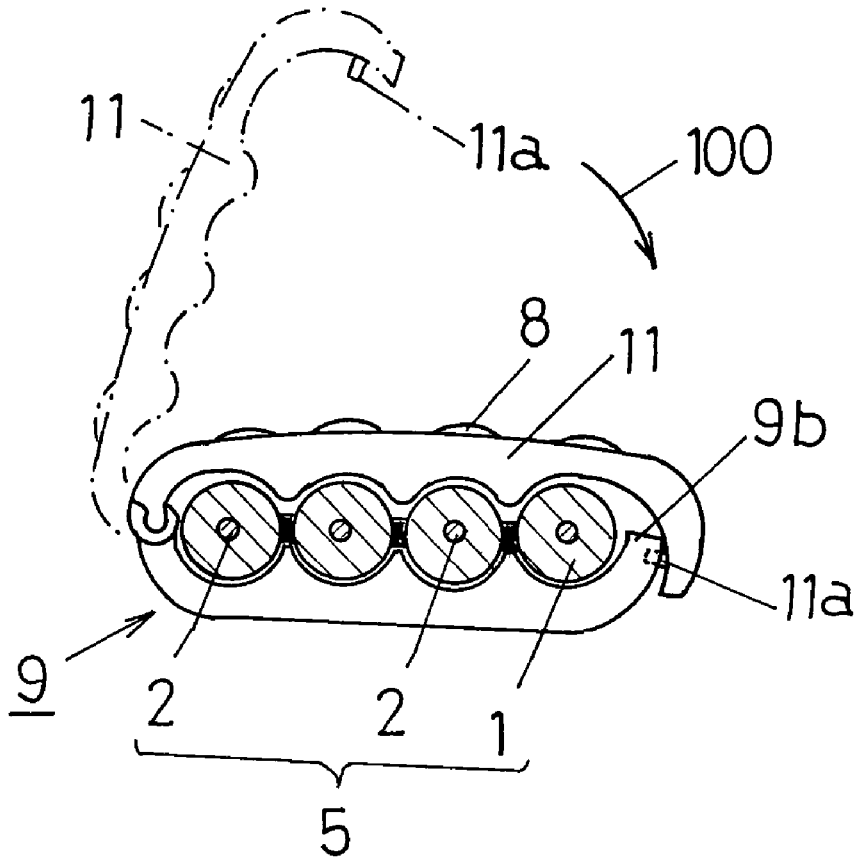
FIG. 3 is a sectional view illustrating the band retainer in the band-like ring of FIG. 1, showing how the band is securely held by the band retainer that includes the mounting plate and jewel support plate.

The band-like ring 10 according to this embodiment described above may be mounted on the finger by following the steps described below. The band-like ring is initially placed in its unfolded state as shown in FIG. 1. Then, the band 5 may be wound around the finger so that the fastener 12 on the forward end side of the band 5 can be passed through the buckle frame 6. After adjusting the length of the band 5 to fit the size of the finger, the forward end of the hook rod 7 may be made to extend through the gap between the white gold beads 1, 1 and thread 2 of the band 5. Then, the band 5 may be sandwiched between the mounting member 9 and jewel support plate 11 so that it can be securely held by them, as shown in FIG. 3. This may cause the forward end of the band 5 to engage the side of the middle portion of the band 5 located nearer to the base end side of the band 5. Finally, the band-like ring can be mounted on the finger in the state shown in FIG. 2.

When the band-like ring is mounted in the state shown in FIG. 2, the length of the band may be adjusted to any desired length by changing the location of the hook rod 7 so that its head can be placed in the appropriate position on the band where the hook rod 7 can be made to engage the band. As the head of the hook rod 7 can be secured to the band 5 by allowing the hook 12*a* at the head to engage the band 5, there is no risk of the head making contact with any other object or being caught by any other object.

As shown in FIG. 2, the buckle frame 6 and jewel support plate 11 have a plurality of jewel beads 8 mounted on the respective face sides (i.e. outer sides) thereof. Thus, the jewels including white gold, precious metals and jewel beads may appear on the entire area on the face side of the band-like ring 10 when it is actually mounted on the finger.

In the embodiments shown in FIGS. 1 through 4, no jewel beads are provided on the face side (the upper side in FIG. 4) of the hook member 12 coupled with the forward end of the band 5. It should be understood, however, that jewel beads may be mounted on the face side of the hook member 12.

As described above in connection with the embodiments shown in FIGS. 1 through 4, there are two forms of the band retainer that are provided in the band-like ring 10. Each form of the band retainer may be made to hold the side of the middle portion of the band 5 located nearer to the forward end side of the band 5 that has completely been wound around the finger when the band-like ring 10 is mounted on the finger. One form is the band retainer that includes the mounting member 9 and jewel support plate 11 between which the band 5 may be held securely. The other form is the buckle-type band retainer that includes the buckle frame 6 that is mounted to the base end of the band 5 and a hook rod 7 having its base end mounted pivotally to the base end of the buckle frame 6 and having its forward end adapted to engage the band 5 that has been passed through the buckle frame 6.

The band-like ring may be configured only to include one form of the band retainer. Even if either form of the band retainer is included, such band retainer may be used to fine-adjust the length of the band 5 according to the particular size of the finger on which the band-like ring is being mounted.

When the band retainer that includes the mounting member 9 and jewel support plate 11 is provided in the band-like ring, the length of the band 5 may also be fine-adjusted according to the particular size of the finger on which the band-like ring is to be mounted, by changing the location of the hook 12*a* in the hook member provided on the forward end of the band 5 to any appropriate position where the hook 12*a* is to engage the band 5.

In the embodiments shown in FIGS. 1 through 4, the band 5 is woven by threading threads 2 through the thread holes on the individual white gold beads. The band 5 may also be woven by using individual platinum beads in place of the white gold beads.

The band 5 may take the form of a chain band including a plurality of precious metal sub-chains linked to each other, or may take the form of a ring band including a plurality of precious metal sub-rings that are linked to each other by threading threads through the sub-rings.

In any case, the band 5 may be provided by linking a plurality of tiny jewel or precious metal beads together by threading threads through the thread holes on the beads, by linking a plurality of tiny precious metal sub-chains together, or by linking a plurality of tiny precious metal sub-rings together. When the band-like ring 10 is then to be mounted around the finger, the length of the band 5 may be adjusted to any desired length by fine-adjusting the location of the hook rod 7 engaging the band 5 or by fine-adjusting the location of the hook 12*a* engaging the band 5.

EMBODIMENT 2

The embodiment that will now be described by referring to FIGS. 5 through 9 differs from the embodiment that has been described by referring to FIGS. 1 through 4, in three points that will be described below.

The first difference is that the buckle-type band retainer including the buckle frame 6 and hook rod 7 is employed in the first embodiment, whereas no such band retainer is employed in the second embodiment. The second difference is that the band retainer including the mounting member and jewel support plate for holding the band 5 therebetween according to the second embodiment includes the shape of a character (such as an alphabetic letter M) that appears on the face side of the band 5 on which the jewel beads are mounted. The third difference is that the hook on the fastener 12 according to the second embodiment has a different form from that according to the first embodiment. Other parts are identical, and similar parts are given similar reference numerals. Those parts that are common to both of the first and second embodiments are not described here to avoid duplication.

Figure 6:
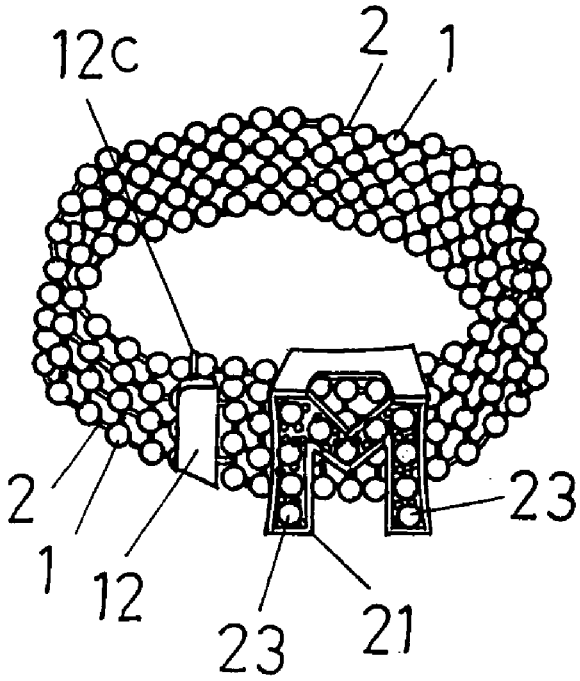
FIG. 6 is a perspective view illustrating the band-like ring of FIG. 5, as it is mounted on the finger.
Figure 7:
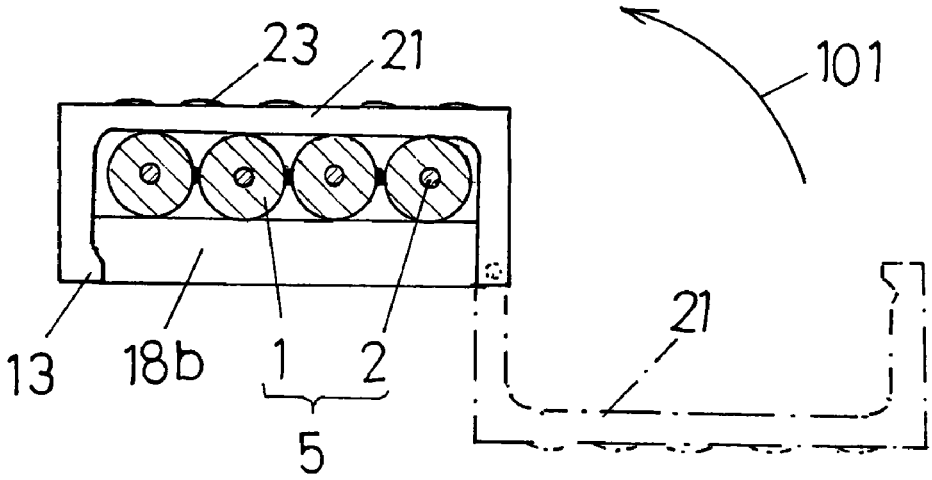
FIG. 7 is a sectional view illustrating the band retainer in the band-like ring of FIG. 5, showing how the band is securely held by the band retainer that includes the mounting plate and jewel support plate.
Figure 8:
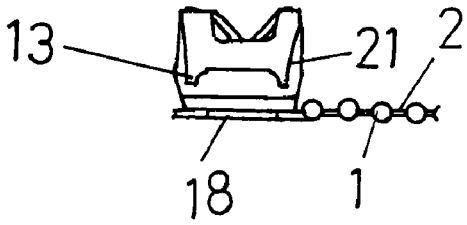
FIG. 8 is a side view of the band retainer shown in FIG. 7.

The band 5 may be provided by threading gold threads 2 through a plurality of gold beads 1 having thread holes, such as tiny jewels, precious metals and the like. A plate 18 has one lateral edge mounted pivotally to the base end of the band 5 (the right-hand side in FIG. 5). A jewel support plate 21 has a base end mounted pivotally to the side of the plate 18 perpendicular to the one lateral edge of the plate 18 (the lower side in FIG. 5). The jewel support plate 21 includes hooks 13, 13 on its forward end side. As shown in FIG. 6, the jewel support plate 21 has the shape of a character (such as an alphabetic letter M) that appears on the face side thereof on which jewel beads 23 are mounted. When the jewel support plate 21 is rotated in the direction of an arrow 101 in FIG. 7, the hooks 13, 13 on the forward end of the jewel support plate 21 engage the upper side of the plate 18 in FIG. 5 (the left-hand side in FIG. 7). After adjusting the length of the band 5 that has been wound around the finger according to the size of the finger, the band 5 may be held securely between and by the plate 18 and jewel support plate 21. In the embodiment shown in FIGS. 5 through 9, the hook member that is adapted to engage the band 5 includes a fastener 12 and a hook 12*c* extending from the fastener 12, in which the fastener 12 has the same construction and function as the corresponding fastener 12 in the embodiment shown in FIGS. 1 through 4. However, the hook 12*c* has a construction and function that are different from those of the corresponding hook 12*c* in the embodiment shown in FIGS. 1 through 4.

Figure 9:
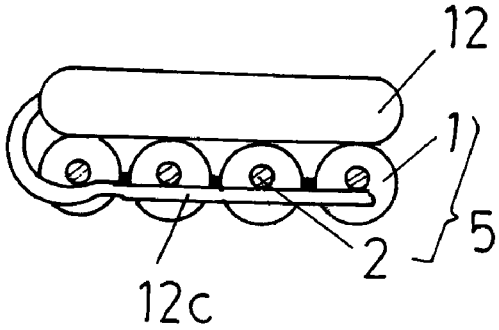
FIG. 9 is a side view illustrating the hook member in the band-like ring of FIG. 5, showing how the hook means engages the forward end of the band.

More specifically, as shown in FIG. 9, the hook 12*c* may be made to engage, from the lateral side, the side of the middle portion of the band 5 located nearer to the base end of the band 5, and thus will be located behind the forward end side of the band 5 held by the band retainer including the plate 18 and jewel support plate 21 and extending beyond the band retainer when the band-like ring 10 is mounted on the finger.

When the band-like ring 20 is to be mounted on the finger, the length of the band 5 that is being wound around the finger may be adjusted to any length according to the size of the finger by allowing the band retainer including the plate 18 and jewel support plate 21 to hold the side of the middle portion located nearer to the forward end side of the band 5 that will have been wound around the finger when the band-like ring 20 has been mounted on the finger.

Because the forward end side of the band 5 can be held stably by the hook 12*c* engaging the band 5, there is no risk of the forward end making contact with any other items or being caught by any other items.

The band-like ring according to this embodiment has an advantage in that the mounting and removal of the ring on and from the finger can be facilitated by allowing the plate 18 and jewel support plate 21 to hold the side of the middle portion of the band 5 located nearer to the forward end of the band 5 that has completely been wound around the finger when the band-like ring 20 is mounted on the finger.

Another advantage of the band-like ring according to this embodiment is that the jewel support plate 21 is formed such that the shape of a particular character or letter can appear on the face side thereof, such as the initials of the name identifying the user of the ring.

EMBODIMENT 3

Figure 10:
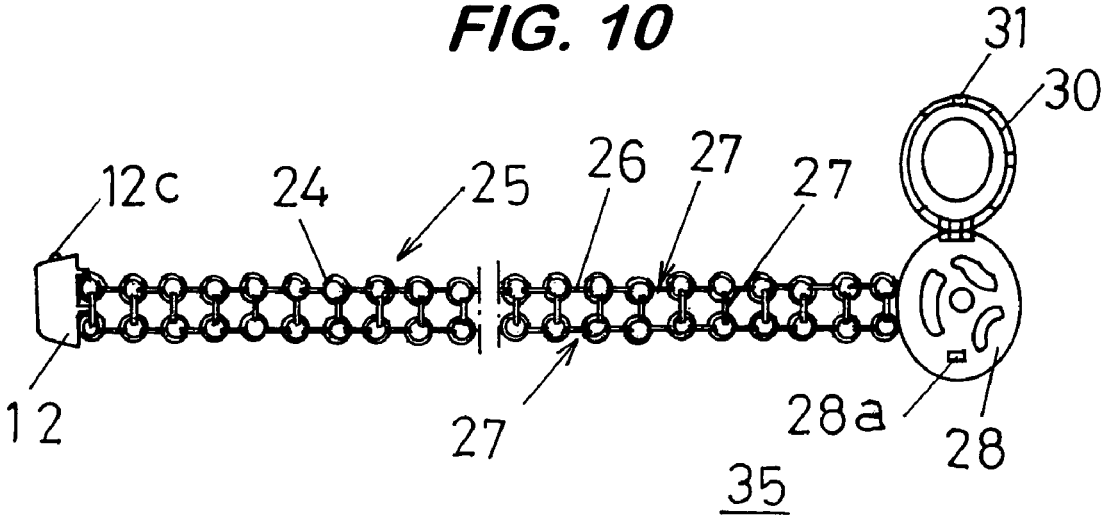
FIG. 10 is a plan view of the band-like ring according to still another embodiment of the present invention as it is unfolded with the middle portion thereof being omitted, as viewed from the face side thereof.
Figure 11:
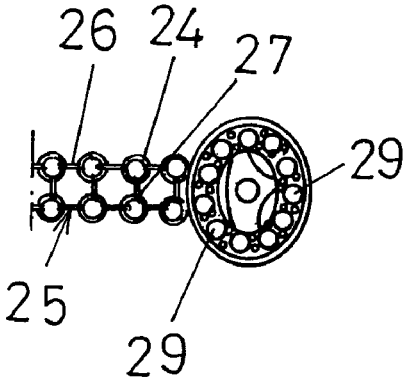
FIG. 11 is a plan view of the band retainer in the band-like ring of FIG. 10, as the band retainer is placed in its closed position.
Figure 12:
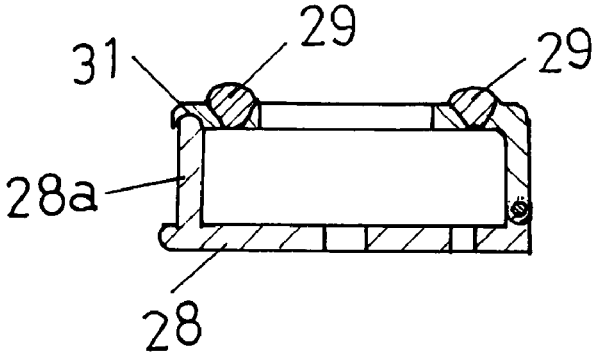
FIG. 12 is a sectional view illustrating the band retainer in the band-like ring of FIG. 10, wherein the band retainer includes a plate and a jewel support plate, showing that the band retainer is placed in its closed position.

The band-like ring 35 according to the embodiment that will now be described by referring to FIGS. 10 through 12 differs from the band-like ring according to the embodiment that has been described by referring to FIGS. 5 through 9 in two points that are described below.

The first difference is that the band 25 is woven by linking a plurality of tiny precious metal sub-rings 24 together by threading threads 26 through the sub-rings. The second difference is that in the band retainer including the mounting member and jewel support plate for holding the band 25 therebetween according to the third embodiment, the jewel support plate has an elliptical shape on the face side of the band 25 on which jewel beads are mounted. Other parts are identical, and similar parts are given similar reference numerals. Those parts that are common to both of the first and second embodiments are not described here to avoid duplication.

The band 25 includes two rows 27, 27 of gold sub-rings 24, each having an inner diameter of 1 mm, that are linked together serially and transversely by threading gold threads 26 through the sub-rings. A plate 28 having an elliptical shape has one lateral edge mounted pivotally to the base end of the band 25 (the left-hand side in FIG. 10).

A jewel support plate 30 having the elliptical shape has its base end mounted pivotally to the side (the upper side in FIG. 10) of the plate 28 perpendicular to the above-mentioned lateral edge thereof. The jewel support plate 30 includes a hook 31 that is provided behind the forward end thereof for engaging a corresponding hook 28*a* on the plate 28, as shown in FIG. 12. The jewel support plate 30 further includes a plurality of jewel beads 29 that are mounted on the face side thereof, as shown in FIGS. 11 and 12.

When the band-like ring 35 is mounted on the finger, the middle portion that is located nearer to the forward end of the band 25 can be held between and by the plate 28 and jewel support plate 30.

EMBODIMENT 4

The embodiment that will now be described by referring to FIGS. 13 through 14 only differs from the embodiment that has been described by referring to FIGS. 5 through 9 in one point. The difference is the construction and function of the band retainer that holds the middle portion of the side of the band located nearer to the forward end of the band that has completely been wound around the finger when the band-like ring is mounted on the finger. Other parts are identical, and similar parts are given similar reference numerals. Those parts that are common to both of the first and second embodiments are not described here to avoid duplication.

Figure 13:
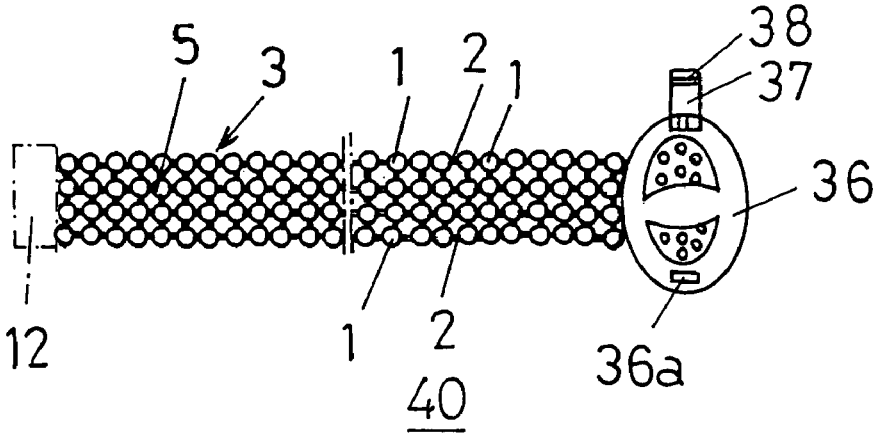
FIG. 13 is a plan view of the band-like ring according to a further embodiment of the present invention as it is unfolded with the middle portion thereof being omitted, as viewed from the face side thereof.
Figure 14:
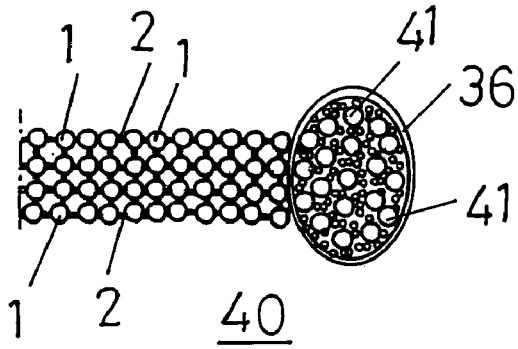
FIG. 14 is a plan view of the band retainer in the band-like ring of FIG. 13, showing that the band retainer is placed in its closed position.

The elliptical jewel support plate 36 has one lateral edge mounted pivotally to the base end of the band 5 (the right-hand side in FIG. 13). The jewel support plate 36 further includes a plurality of jewel beads 41 that are mounted on the face side thereof, as shown in FIG. 14.

Behind the jewel support plate 36, as shown in FIG. 13, a holder plate 37 has its base end mounted pivotally to the side (the upper side in FIG. 13) of the jewel support plate 36 perpendicular to the above-mentioned lateral edge of the jewel support plate 36. The jewel support plate 36 further includes a hook 36*a* that is provided on the lower side in FIG. 13 behind the jewel support plate 36 for engaging a corresponding hook 38 provided on the forward end of the holder plate 37.

When the band-like ring 40 is mounted on the finger, the middle portion that is located nearer to the forward end of the band 5 can be held between and by the back side of the jewel support plate 36 and holder plate 37.

EMBODIMENT 5

Figure 16:
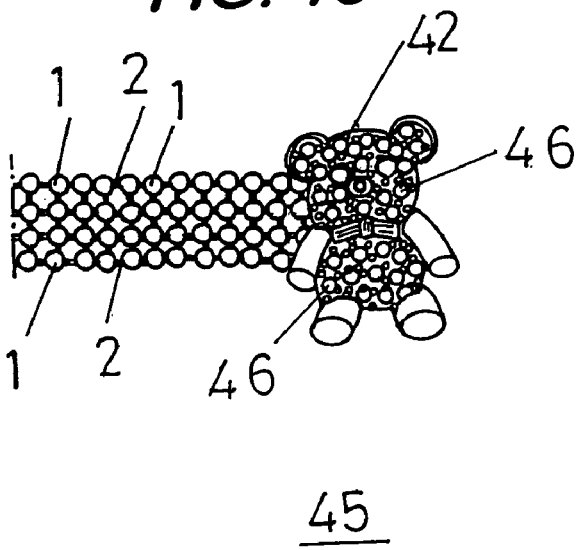
FIG. 16 is a plan view of the band retainer in the band-like ring of FIG. 15, showing that the band retainer is placed in its closed position.
Figure 17:
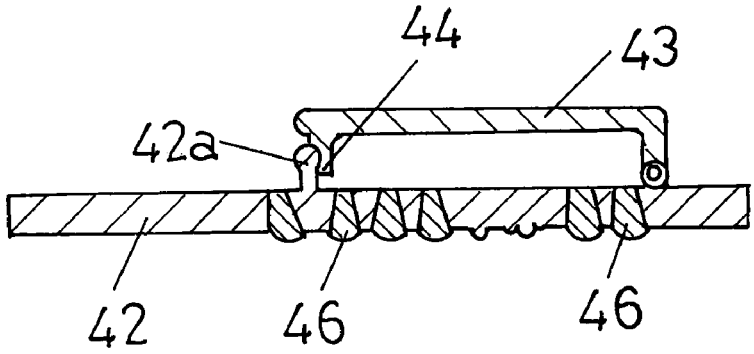
FIG. 17 is a sectional view illustrating the band retainer in the band-like ring of FIG. 15, wherein the band retainer includes a plate and a jewel support plate, showing that the band retainer is placed in its closed position.

The embodiment that will now be described by referring to FIGS. 15 through 17 only differs from the embodiment that has been described by referring to FIGS. 5 through 9 in one point. The difference is the construction and function of the band retainer that holds the middle portion of the side of the band located nearer to the forward end of the band that has completely been wound around the finger when the band-like ring is mounted on the finger. Other parts are identical, and similar parts are given similar reference numerals. Those parts that are common to both of the first and second embodiments are not described here to avoid duplication.

The jewel support plate 42 is formed to include the shape of a bear that appears on the face side thereof, and has one lateral edge mounted pivotally to the base end (the right-hand side in FIG. 15) of the band 5. The jewel support plate 42 further includes a plurality of jewel beads 46 that are mounted on the face side thereof, as shown in FIG. 16.

Figure 15:
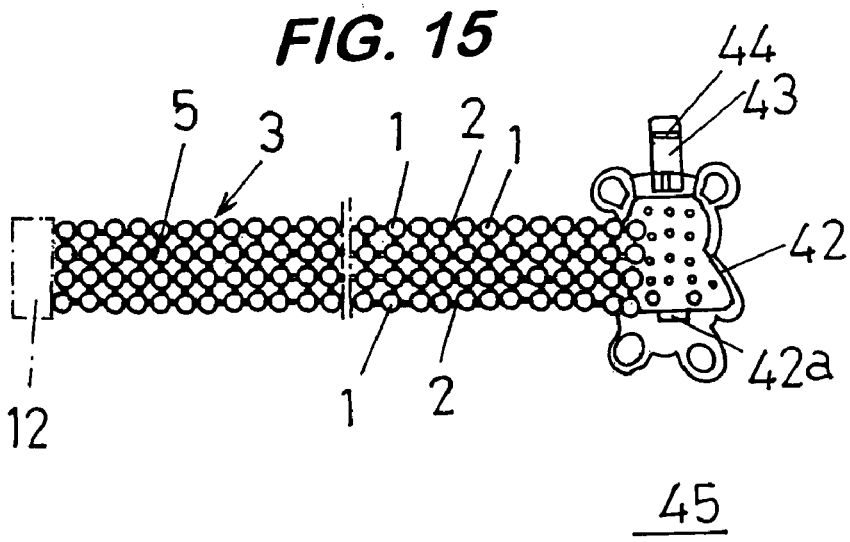
FIG. 15 is a plan view of the band-like ring according to still another embodiment of the present invention as it is unfolded with the middle portion thereof being omitted, as viewed from the face side thereof.

Behind the jewel support plate 42, as shown in FIG. 15, a holder plate 43 has its base end mounted pivotally to the side (the upper side in FIG. 15) of the jewel support plate 42 perpendicular to the above-mentioned lateral edge of the jewel support plate 42. The jewel support plate 42 further includes a hook 42*a* that is provided on the lower side in FIG. 15 behind the jewel support plate 42 for engaging a corresponding hook 44 provided on the forward end of the holder plate 43.

When the band-like ring 45 is mounted on the finger, the middle portion that is located nearer to the forward end of the band 5 can be held between and by the back side of the jewel support plate 42 and holder plate 43.

EMBODIMENT 6

The embodiment that will now be described by referring to FIGS. 18 through 20 only differs from the embodiment that has been described by referring to FIGS. 5 through 9 in one point. The difference is the construction and function of the band retainer that holds the middle portion of the side of the band located nearer to the forward end of the band that has completely been wound around the finger when the band-like ring 50 is mounted on the finger. Other parts are identical, and similar parts are given similar reference numerals. Those parts that are common to both of the first and second embodiments are not described here to avoid duplication.

A plate 47 has one lateral edge mounted pivotally to the base end (the right-hand side in FIG. 5) of the band 5. The jewel support plate 48, 48 has its base end mounted pivotally to the side of the plate 47 (the upper side in FIG. 18) perpendicular to the above-mentioned lateral edge of the plate 47. It may be seen in FIG. 20 that the jewel support plate 48 further includes a hook 49, 49 that is provided on the forward end thereof for engaging a corresponding hook 52, 52 provided on the lower side of the plate 47. As shown in FIG. 19, the jewel support plate 48, 48 is formed such that the shape of a particular character or letter (such as an alphabetic letter X) appears on the face side of the jewel support plate on which jewels 51 are mounted.

After adjusting the length of the band 5 that has been wound around the finger according to the size of the finger, the band 5 may be held securely between and by the plate 47 and jewel support plate 48, 48

Figure 18:
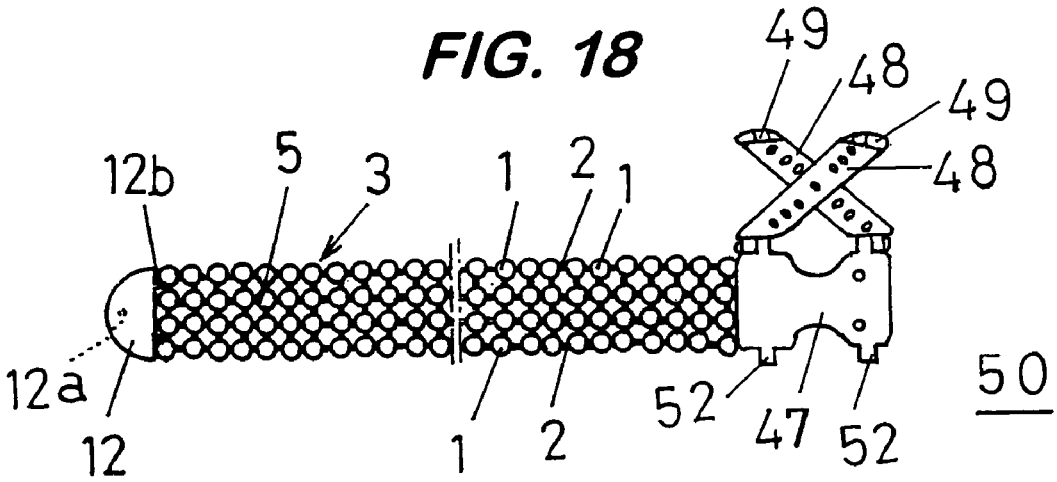
FIG. 18 is a plan view of the band-like ring according to still another embodiment of the present invention as it is unfolded with the middle portion thereof being omitted, as viewed from the face side thereof.
Figure 19:
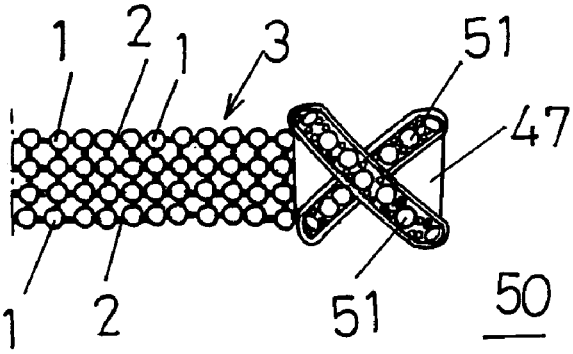
FIG. 19 is a plan view of the band retainer in the band-like ring, showing that the band retainer is placed in its closed position.
Figure 20:
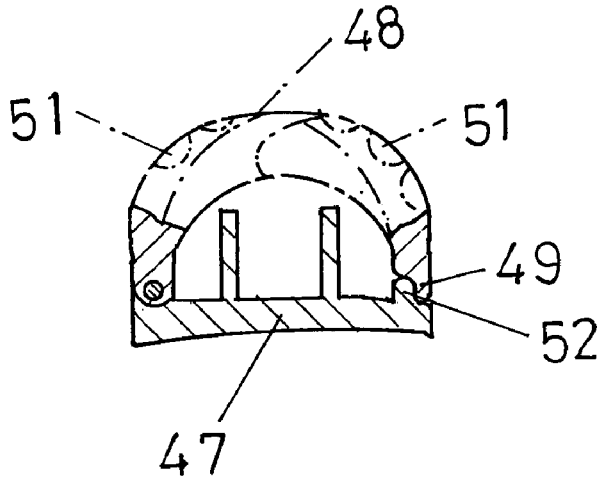
FIG. 20 is a sectional view illustrating the band retainer in the band-like ring of FIG. 18, wherein the band retainer includes a plate and a jewel support plate, showing that the band retainer is placed in its closed position.

In the embodiment shown in FIGS. 18 through 20, the hook member that is adapted to engage the band 5 may include a fastener 12 and a hook 12*a* extending from the fastener 12, the fastener 12 and hook 12*a* being the same as those in the embodiment shown in FIGS. 1 through 4.

EMBODIMENT 7

Figure 21:
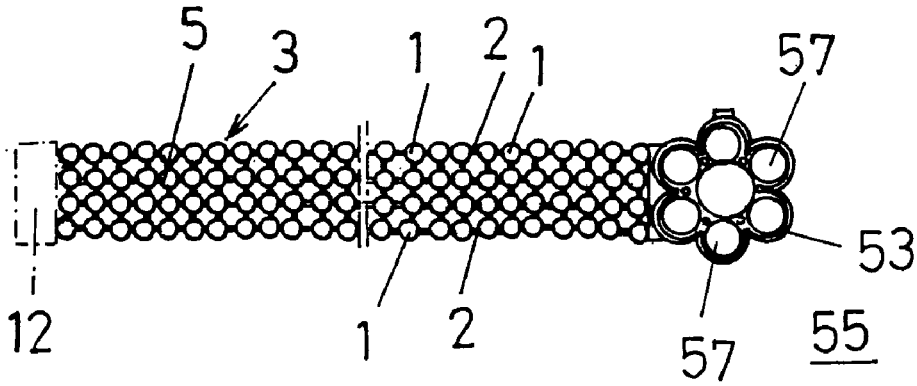
FIG. 21 is a plan view of the band-like ring according to still another embodiment of the present invention as it is unfolded with the middle portion thereof being omitted, as viewed from the face side thereof.

The embodiment that will now be described by referring to FIGS. 21 through 23 only differs from the embodiment that has been described by referring to FIGS. 5 through 9 in one point. The difference is the construction and function of the band retainer that holds the middle portion of the side of the band located nearer to the forward end of the band that has completely been wound around the finger when the band-like ring is mounted on the finger. Other parts are identical, and similar parts are given similar reference numerals. Those parts that are common to both of the first and second embodiments are not described here to avoid duplication.

The jewel support plate 53 is formed such that it includes the shape of a particular flower appearing on the face side thereof, and has one lateral edge mounted pivotally to the base end (the right-hand side in FIG. 21) of the band 5. The jewel support plate 53 further includes a plurality of jewel beads 57 that are mounted on the face side thereof, as shown in FIG. 21.

Figure 22:
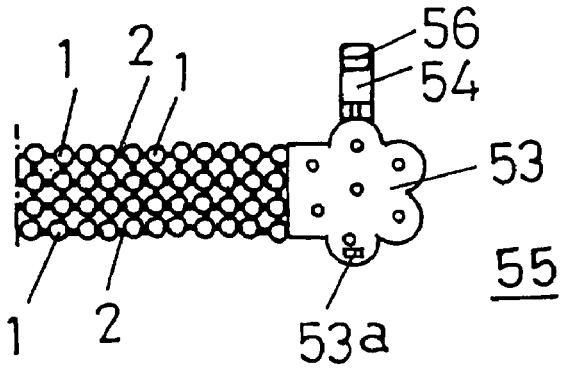
FIG. 22 shows the rear side of the band retainer in the band-like ring of FIG. 21.
Figure 23:
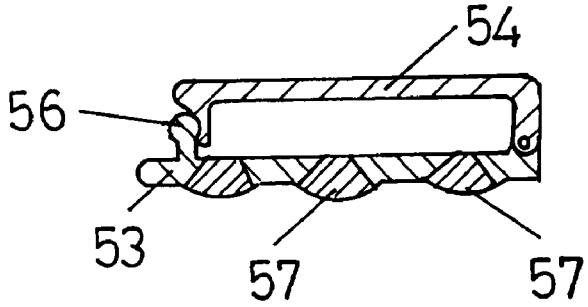
FIG. 23 is a sectional view illustrating the band retainer in the band-like ring of FIG. 21, wherein the band retainer includes a plate and a jewel support plate, showing that the band retainer is placed in its closed position.

Behind the jewel support plate 53, as shown in FIG. 22, a holder plate 54 has its base end mounted pivotally to the side (the upper side in FIG. 22) of the jewel support plate 53 perpendicular to the above-mentioned lateral edge of the jewel support plate 53. The jewel support plate 53 further includes a hook 53*a* that is provided on the lower side in FIG. 22 behind the jewel support plate 53 for engaging a hook 56 provided on the forward end of the holder plate 54.

When the band-like ring 55 is mounted on the finger, the middle portion that is located nearer to the forward end of the band 5 can be held between and by the back side of the jewel support plate 53 and holder plate 54.

EMBODIMENT 8

Figure 24:
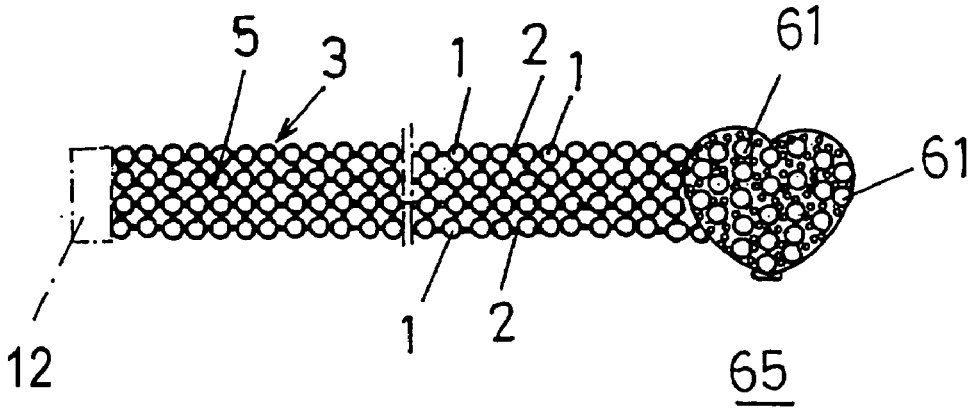
FIG. 24 is a plan view of the band-like ring according to still another embodiment of the present invention as it is unfolded with the middle portion thereof being omitted, as viewed from the face side thereof.

The embodiment that will now be described by referring to FIGS. 24 through 26 only differs from the embodiment that has been described by referring to FIGS. 5 through 9 in one point. The difference is the construction and function of the band retainer that holds the middle portion of the side of the band located nearer to the forward end of the band that has completely been wound around the finger when the band-like ring 65 is mounted on the finger. Other parts are identical, and similar parts are given similar reference numerals. Those parts that are common to both of the first and second embodiments are not described here to avoid duplication.

The jewel support plate 59 is formed such that it includes the shape of a heart mark appearing on the face side thereof, and has one lateral edge mounted pivotally to the base end (the right-hand side in FIG. 24) of the band 5. The jewel support plate 59 further includes a plurality of jewel beads 61 that are mounted on the face side thereof, as shown in FIG. 24.

Figure 25:
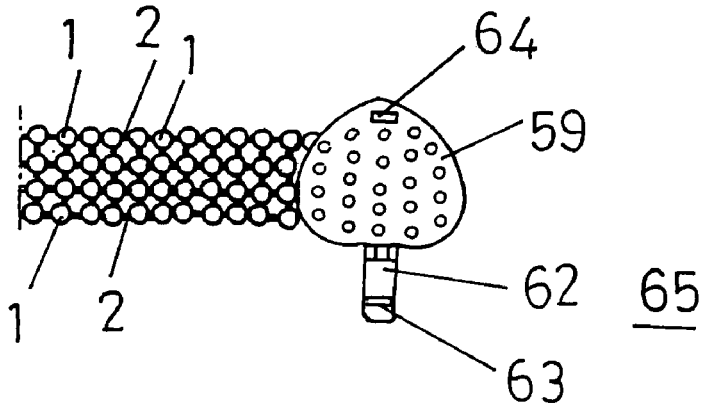
FIG. 25 shows the rear side of the band retainer in the band-like ring of FIG. 24.
Figure 26:
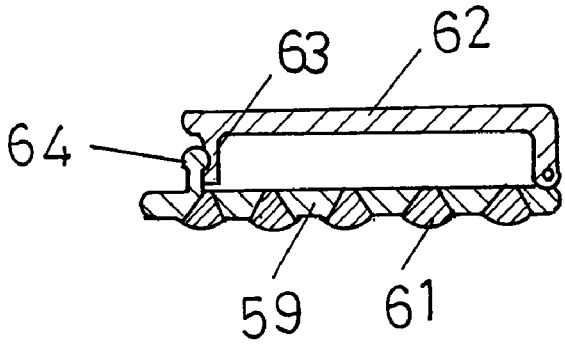
FIG. 26 is a sectional view illustrating the band retainer in the band-like ring of FIG. 24, wherein the band retainer includes a plate and a jewel support plate, showing that the band retainer is placed in its closed position.

Behind the jewel support plate 59, as shown in FIG. 25, a holder plate 62 has its base end mounted pivotally to the side (the lower side in FIG. 25) of the jewel support plate 59 perpendicular to the above-mentioned lateral edge of the jewel support plate 59. The jewel support plate 59 further includes a hook 64 that is provided on the upper side in FIG. 25 behind the jewel support plate 59 for engaging a hook 63 provided on the forward end of the holder plate 62.

When the band-like ring 65 is mounted on the finger, the middle portion that is located nearer to the forward end of the band 5 can be held between and by the back side of the jewel support plate 59 and holder plate 62.

EMBODIMENT 9

Figure 27:
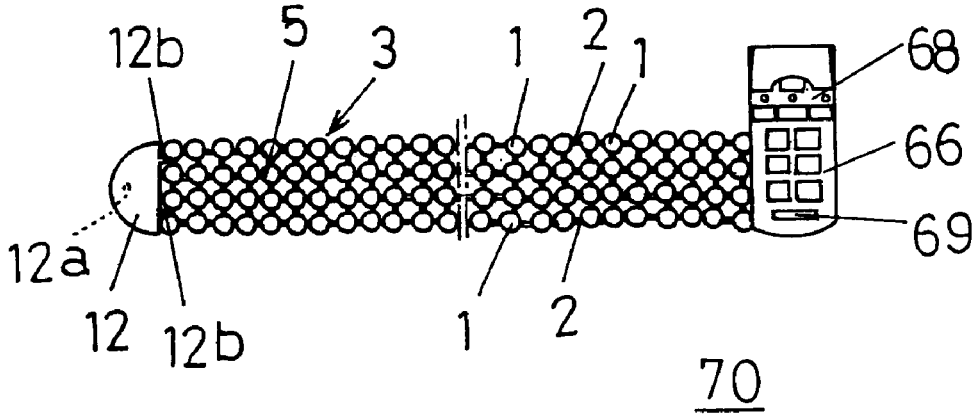
FIG. 27 is a plan view of the band-like ring according to still another embodiment of the present invention as it is unfolded with the middle portion thereof being omitted, as viewed from the face side thereof.

The embodiment that will now be described by referring to FIGS. 27 through 29 only differs from the embodiment that has been described by referring to FIGS. 5 through 9 in one point. The difference is the construction and function of the band retainer that holds the middle portion of the side of the band located nearer to the forward end of the band that has completely been wound around the finger when the band-like ring is mounted on the finger. Other parts are identical, and similar parts are given similar reference numerals. Those parts that are common to both of the first and second embodiments are not described here to avoid duplication.

A plate 66 has one lateral edge mounted pivotally to the base end (the right-hand side) of the band 5. The jewel support plate 68 has its base end mounted pivotally to the side of the plate 66 (the upper side in FIG. 27) perpendicular to the above-mentioned lateral edge of the plate 66. The jewel support plate 68 further includes a hook 68*a* that is provided on the forward end side thereof for engaging a corresponding hook 69 provided on the lower side in FIG. 27 of the plate 66.

Figure 28:
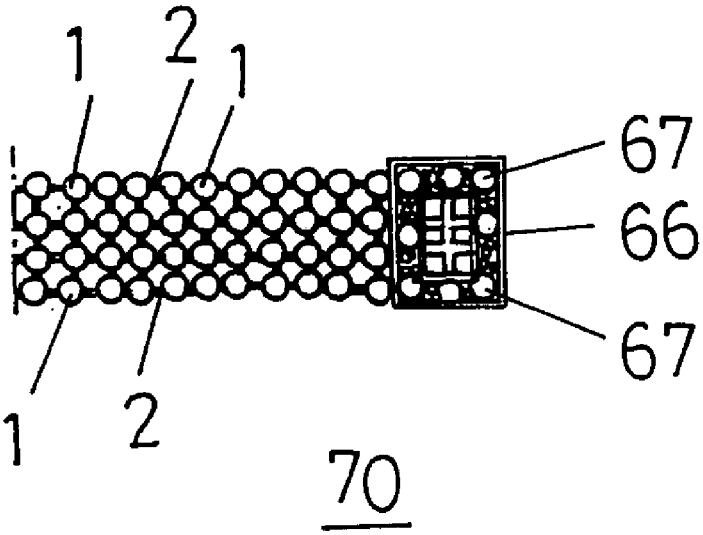
FIG. 28 is a plan view of the band retainer in the band-like ring of FIG. 27, showing that the band retainer is placed in its closed position.
Figure 29:
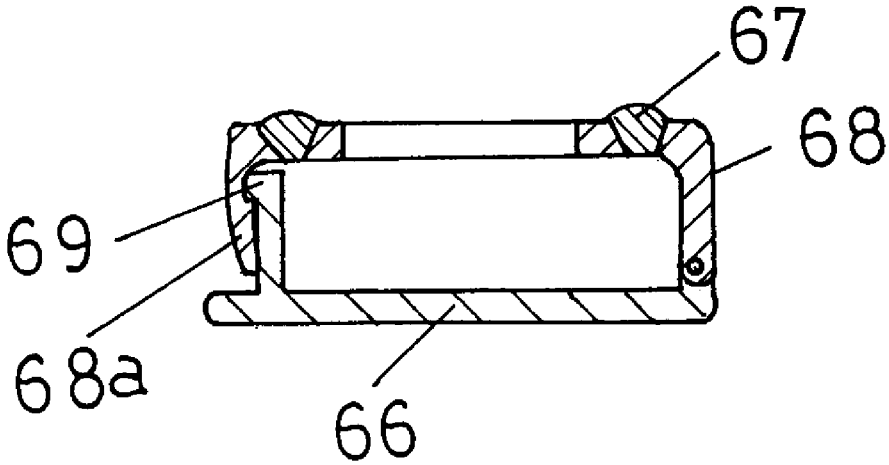
FIG. 29 is a sectional view illustrating the band retainer in the band-like ring of FIG. 27, wherein the band retainer includes a plate and a jewel support plate, showing that the band retainer is placed in its closed position.

The jewel support plate 68 is formed to have a rectangular shape having a central opening on the face side thereof, as shown in FIG. 28, and includes a plurality of jewel beads 67 on the face side thereof that are mounted on the four sides surrounding the opening.

When the band-like ring 70 is mounted on the finger, the middle portion that is located nearer to the forward end of the band 5 can be held between and by the back side of the jewel support plate 68 and holder plate 66.

Although the present invention has been described with reference to several particular preferred embodiments thereof shown in the accompanying drawings, it should be understood that the present invention is not limited to the embodiments illustrated and shown, and that various changes and modifications may be made to those embodiments without departing from the spirit and scope of the invention as defined in the appended claims.

The invention claimed is:

1. An adjustable band ring comprising:

a band having a base end and a distal end opposite said base end;

a band retainer on said base end of said band, said band retainer being operable to hold a first middle portion of said band spaced from said base end when said band is wound around and mounted on a finger;

a hook member on said distal end of the band such that said hook member extends past said band retainer when said band is wound around and mounted on a finger, said hook member being operable to engage a second middle portion of said band by extending into said band so as to fasten said distal end of said band to said second middle portion, wherein said hook member includes:

a fastener;

a clasp part attaching said fastener to said distal end of said band; and a hook extending outward from said fastener so as to extend into a gap within said second middle portion of said band when said band is wound around the finger; and a plurality of jewel beads mounted on an outer face of said band retainer.

2. The adjustable band ring of claim 1, wherein said band comprises one of:

a band including a thread through a thread hole in each of a plurality of tiny jewel or precious metal beads;

a chain band including joined sub-chains made of precious metals; and a ring band including joined sub-rings made of precious metals.

3. The adjustable band ring of claim 1, wherein said first middle portion of said band is located closer to said distal end of said band than is said second middle portion.

4. The adjustable band ring of claim 1, wherein said band retainer includes:

a frame having a base end secured to said base end of said band; and a stop member having a base end pivotally mounted to said base end of said frame and having a forward end abutting against said first middle portion of said band when said band is wound around the finger.

5. The adjustable band ring of claim 4, further comprising a plurality of jewel beads mounted on an outer face of said frame.

6. The adjustable band ring of claim 1, wherein said band retainer includes:

a plate having a lateral edge secured to said base end of said band; and a jewel support plate having:

a base end pivotally mounted to a first side of said plate oriented perpendicular to said lateral edge of said plate;

a hook portion on a distal end opposite said base end of said jewel support plate, said hook portion being shaped and arranged to engage a second side of said plate opposite said first side; and a plurality of jewel beads mounted on an outer face thereof.

7. The adjustable band ring of claim 6, wherein said outer face of said jewel support plate is shaped as a character or a letter.

8. The adjustable band ring of claim 6, wherein said outer face of said jewel support plate is shaped as an animal.

9. The adjustable band ring of claim 6, wherein said outer face of said jewel support plate is shaped as a heart.

10. The adjustable band ring of claim 6, wherein said outer face of said jewel support plate has a rectangular shape with a central opening.

11. The adjustable band ring of claim 1, wherein said hook member further includes:

a buckle coupled to said distal end of said band; and a hook extending from said buckle, said hook being shaped and arranged to engage said second middle portion of said band.

12. The adjustable band ring of claim 11, wherein said buckle includes a plurality of jewel beads mounted on an outer face thereof.

13. The adjustable band ring of claim 1, wherein said band retainer includes:

a mounting member attached to said base end of said band; and a jewel support plate pivotally mounted to said mounting member such that, when said band is wound around the finger so that said band retainer holds said first middle portion of said band, said first middle portion is located between said mounting member and said jewel support plate.

14. The adjustable band ring of claim 13, wherein each of said mounting member and said jewel support plate has a hook member for engaging each other so as to hold said first middle portion.

* * * * *